United States Patent [19]

Lehman et al.

[11] Patent Number: 4,794,422

[45] Date of Patent: Dec. 27, 1988

[54] ELECTROPHOTOGRAPHIC REPRODUCTION MACHINE WITH DOCUMENT EXPOSURE SYSTEM DIRECTLY COUPLED TO AC LINE INPUT

[75] Inventors: Richard F. Lehman, Webster; David K. Shogren, Ontario; Thomas J. Hammond; Lawrence J. Mason, both of Penfield, all of N.Y.

[73] Assignee: Xerox Corporation, Stamford, Conn.

[21] Appl. No.: 125,795

[22] Filed: Nov. 27, 1987

Related U.S. Application Data

[63] Continuation of Ser. No. 872,328, Jun. 9, 1986, abandoned.

[51] Int. Cl.[4] ..... G03G 15/04

[52] U.S. Cl. ..... 355/14 E; 355/11; 355/68

[58] Field of Search ..... 355/11, 14 E, 16, 14 R, 355/3 FU, 14 FU, 67–70; 315/199

[56] References Cited

U.S. PATENT DOCUMENTS

| | | | |
|---|---|---|---|
| 3,432,231 | 7/1965 | Gardner | 355/16 |
| 3,712,730 | 1/1973 | Florsheim, Jr. et al. | 355/69 |
| 3,742,295 | 6/1973 | Irie | 315/194 |
| 3,815,992 | 6/1974 | Ogawa | 355/69 |
| 3,977,781 | 8/1976 | Eppe et al. | 355/18 |
| 3,998,539 | 12/1976 | Kidd | 355/69 X |
| 4,046,473 | 9/1977 | Trainor | 355/16 |
| 4,090,108 | 5/1978 | Johnson et al. | 355/14 FU X |
| 4,095,140 | 6/1978 | Kirkhuff et al. | 315/199 |
| 4,153,364 | 5/1979 | Suzuki et al. | 355/14 E |
| 4,272,188 | 6/1981 | Lehman | 355/68 |
| 4,334,767 | 6/1982 | Lehman | 355/68 |
| 4,352,553 | 10/1982 | Hirahara | 355/14 E |
| 4,354,749 | 10/1982 | Hosoda | 354/33 |
| 4,354,758 | 10/1982 | Futaki | 355/14 E |
| 4,360,783 | 11/1982 | Nagasawa et al. | 328/144 |
| 4,372,679 | 2/1983 | Weber | 355/70 |
| 4,434,353 | 2/1984 | Marsh et al. | 355/3 FU X |
| 4,435,677 | 3/1984 | Thomas | 355/14 FU X |
| 4,624,547 | 11/1986 | Endo et al. | 355/14 E |
| 4,643,560 | 2/1987 | Morse | 355/68 X |

*Primary Examiner*—Arthur T. Grimley
*Assistant Examiner*—J. Pendegrass

[57] ABSTRACT

In a full-frame flash electrophotographic printing machine, an imaging system is provided which incorporates a flash lamp directly coupled to an ac line input to enable document exposure. The imaging system also includes a lens whose movement is synchronized with a moving photoreceptor so that an exposure occurs registered at the same image area of the photoreceptor. The invention further includes circuit means for detecting zero crossing points of the line voltage and for generating signals which are used to trigger the lamp into operation at some point during an 8 msec, half cycle of line operation. Further circuit means are provided for controlling exposure levels to conform to detected density of the document being copied. In a second embodiment, the control circuitry is used to couple the ac line into a flash fuser assembly to fuse a transferred image on an output record medium.

2 Claims, 10 Drawing Sheets

ZERO CROSSOVER DETECTOR AND DELAY

TRIGGER TIMING CIRCUIT

ELECTROPHOTOGRAPHIC REPRODUCTION MACHINE WITH DOCUMENT EXPOSURE SYSTEM DIRECTLY COUPLED TO AC LINE INPUT

This is a continuation of application Ser. No. 872,328, filed June 9, 1986, now abandoned.

The present invention relates to an electrophotographic document reproduction machine and, more particularly, to a control system for coupling energy from an AC line input into the machine and using the line input as a power source for the various xerographic functions requiring a flash radiant energy output. Specific functions such as document exposure and flash fusing are described.

As demands for faster copying and duplicating have increased, conventional machines which scan documents in line increments to provide a flowing image on a xerographic drum have proved inadequate. New, high speed techniques have evolved which utilize flash exposure of an entire document (full-frame flash) and the arrangement of a moving photoreceptor in a flat condition at the instant of exposure. An economic disadvantage of these prior art systems is the requirement for high-energy storage lamp power supplies. typically, the lamps require hundreds of joules of energy, necessitating a power supply which stores the energy in a capacitor or series of capacitors, the energy being periodically released to the lamp during the time the lamp is triggered into operation. These capacitors are generally large, making the power supplies a large, heavy and costly component of a flash illumination system. There are other xerographic functions which are implemented in a document reproduction machine which may utilize flash radiant energy. For example, lamps are typically used to dissipate charge levels on the photoreceptor along areas representing unwanted border regions or inter-document spaces. Flash radiant energy may also be used at the fusing station where a developed image, which has been transferred to an output medium, is permanently affixed. The lamps used to provide the radiant energy for these functions also require power supplies, adding further to the cost of the machine.

It is therefore an object of the present invention to reduce the cost, size and weight of the power supplies required to power the lamps required to enable the above-described functions. This is accomplished, according to the present invention, by coupling the lamps to a standard AC line input source without imposing any voltage means such as a dc power supply. The invention discloses control circuitry required to enable AC line input to the lamp(s), the control circuitry adapted to provide energy pulses to the lamps during positive and/or negative cycles of the AC input. The control circuitry determines the amount of exposure required to enable the particular function and includes timing circuits to coordinate the operation of various xerographic stations. In one embodiment, the invention relates to an electrophotographic document reproduction machine, including means for charging the surface of a photoreceptor medium, a full-frame flash exposure system for illuminating the document and projecting an image onto said charged surface to form a latent image of the document thereon, means for developing said latent image and for transferring said developed image to an output sheet and means for fusing said transferred image onto said output sheet; said machine further including control means connected between an AC line input and at least said exposure system, said control means adapted to cause said exposure system to produce a flash exposure pulse during at least one cycle of said AC input.

Other aspects of the present invention will be apparent as the following description proceeds and with reference to the following drawings.

Figure 1:
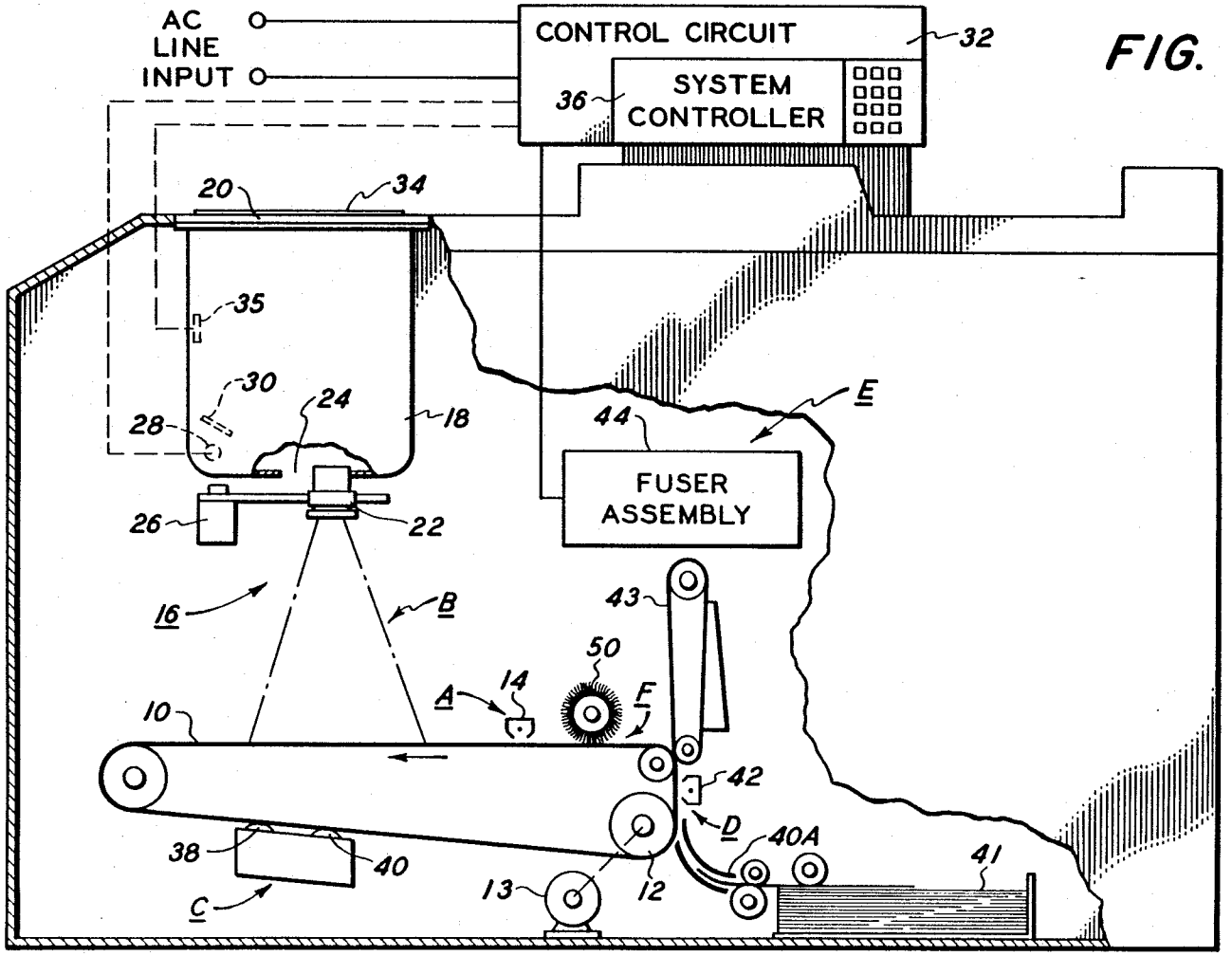
FIG. 1 is a schematic side view of an electrophotographic printing machine incorporating a control circuit connected between the AC line input and the document exposure system.

For a general understanding of the features of the present invention, reference is had to the drawings. FIG. 1 schematically depicts the various components of an illustrative electrophotographic printing machine incorporating the control circuitry of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Belt 10 is driven in the indicated direction by power applied to drive roller 12 via drive motor 13. Successive portions of the photoconductive surface are advanced through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged surface of belt 10 is advanced through exposure station B. The exposure station includes an optical imaging system 16 which includes an optical cavity 18, the upper surface of the cavity accommodating a document platen 20 with the lower surface accommodating a lens 22, movable laterally across an aperture 24 by lens servo drive motor 26. The lens moves in conjunction with sliding plates (not shown) which forms a light seal. Flash lamp 28 is mounted inside the cavity 18 with a blocker 30 positioned above it. Flash lamp 28 is connected to a 120 volt AC line input via control circuit 32. When the belt reaches a predetermined position in exposure station B, lamp 28 is energized during a half cycle of the AC input. The lamp produces a flash output which illuminates a document 34 causing an image of the document to be projected by lens 22 onto the charged surface of belt 10. Lens 22 moves in the same direction as the belt at a predetermined velocity to project a light image of the document onto the surface of the photoconductive belt to selectively dissipate the charge thereon. Photodetector 35 senses the exposure level for a particular document and provides input to an exposure control circuit in control circuit 32 as described in greater detail below.

With continued reference to FIG. 1, at development station C, a pair of magnetic brush developer rollers, indicated generally by the reference numerals 38 and 40, advance a developer material into contact with the electrostatic latent image formed on the belt surface. The latent image attracts toner particles from the carrier granules of the developer material to form a toner powder image on the photoconductive surface of belt 10.

After the electrostatic latent image recorder on the photoconductive surface of belt 10 is developed, belt 10 and the toner powder image therein is advanced to transfer station D. At transfer station D, a copy sheet 40A is fed from tray 41 and moved into contact with the toner powder image. Transfer station D includes a corona generating device 42 which sprays ions onto the backside of the copy sheet. The transfer timing is a function of lens 22 movement and is under the control of system controller 36, as described in detail below. After transfer, conveyor 43 advances the sheet to fusing station E. Fusing station E includes a fuser assembly, indicated generally by the reference numeral 44, which permanently affixes the transferred powder image to the copy sheet. In one embodiment discussed below, fuser assembly 44 includes a plurality of flash lamps powered by line voltage coupled through circuit 32. As the sheet passes through the assembly, the lamps are energized during one or more half cycles of the AC input causing the powder image to become permanently affixed to the sheet. The fused copy sheets are then conveyed to an output tray (not shown).

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 50 in contat with the photoconductive surface of belt 10. These particles are cleaned from the photoconductive surface of belt 10 by the rotaton of brush 50 in contact therewith.

It is believed that the foregoing description is sufficient for purposes of the present application to illustrate the general operation of an electrophotographic printing machine incorporating the features of the present invention therein.

Referring now to the specific subject matter of the present invention, the general operation of the exposure station will be described hereinafter with reference to FIGS. 2 and 3.

Figure 2:
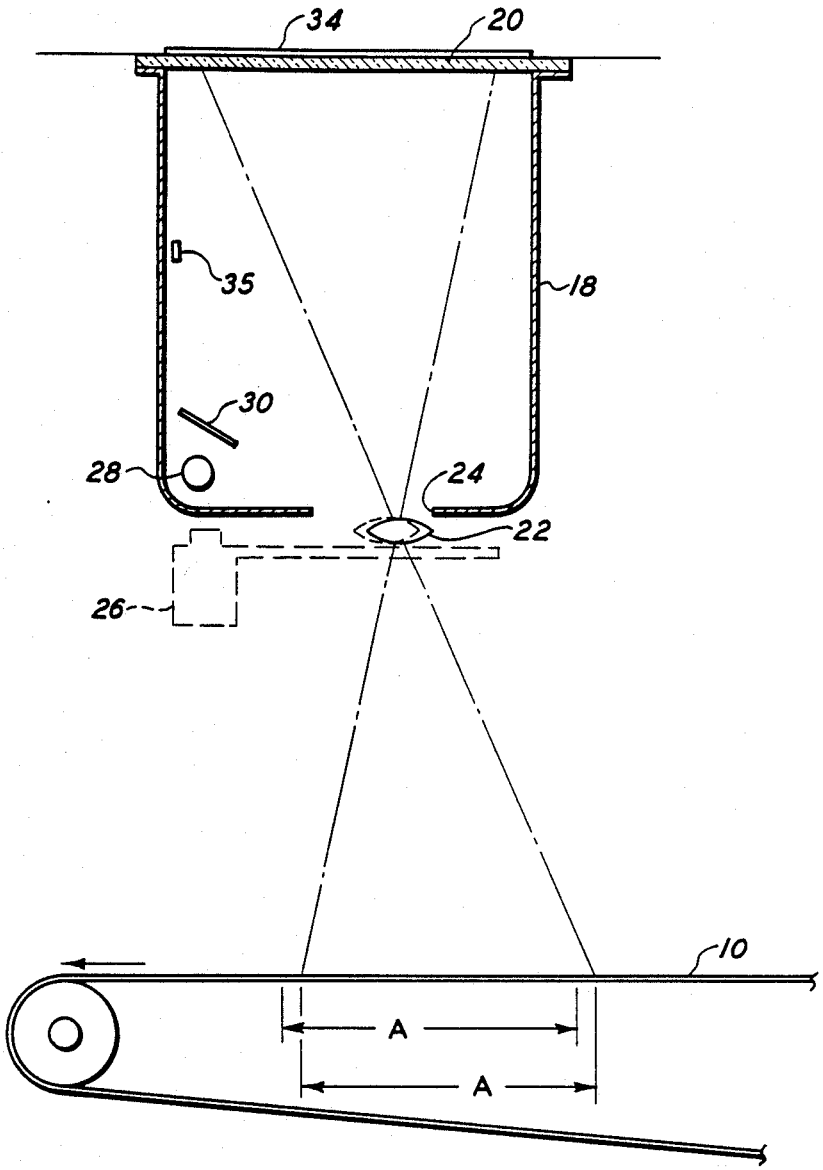
FIG. 2 is a schematic side view of the imaging system of FIG. 1 showing the interaction between the lens movement and the flash lamp firing.

FIG. 2 is a schematic side view of imaging system 16. For the given system design, it is assumed a single lamp flash will be required to provide the required image exposure. In order to produce a blur-free image, lens 22 must travel in the same direction as the photoreceptor and at a speed defined by the following expression:

$$V_{lens} = V_{p/r}/(1+Mag) \quad (1)$$

Assuming a 1:1 magnification, the lens must move during the flash interval at a speed of Vpr/2. Assuming further that the lamp is coupled through circuitry to the 120V, 60 Hz line, the flash interval must occur during a half cycle of the AC input and within an 8 msec pulse width. Thus, if the photoreceptor is moving at 20 inches/sec, the lens must move at 10 inches/sec. During the 8 msec half cycle time, the photoreceptor travels 0.16 inches and the lens travels 0.08 inches. The flash occurs during the 8 msec time interval to produce an image in zone A of the photoreceptor. The lens movement is controlled by signals from control circuit 32 sent to lens drive motor 26.

Figure 3:
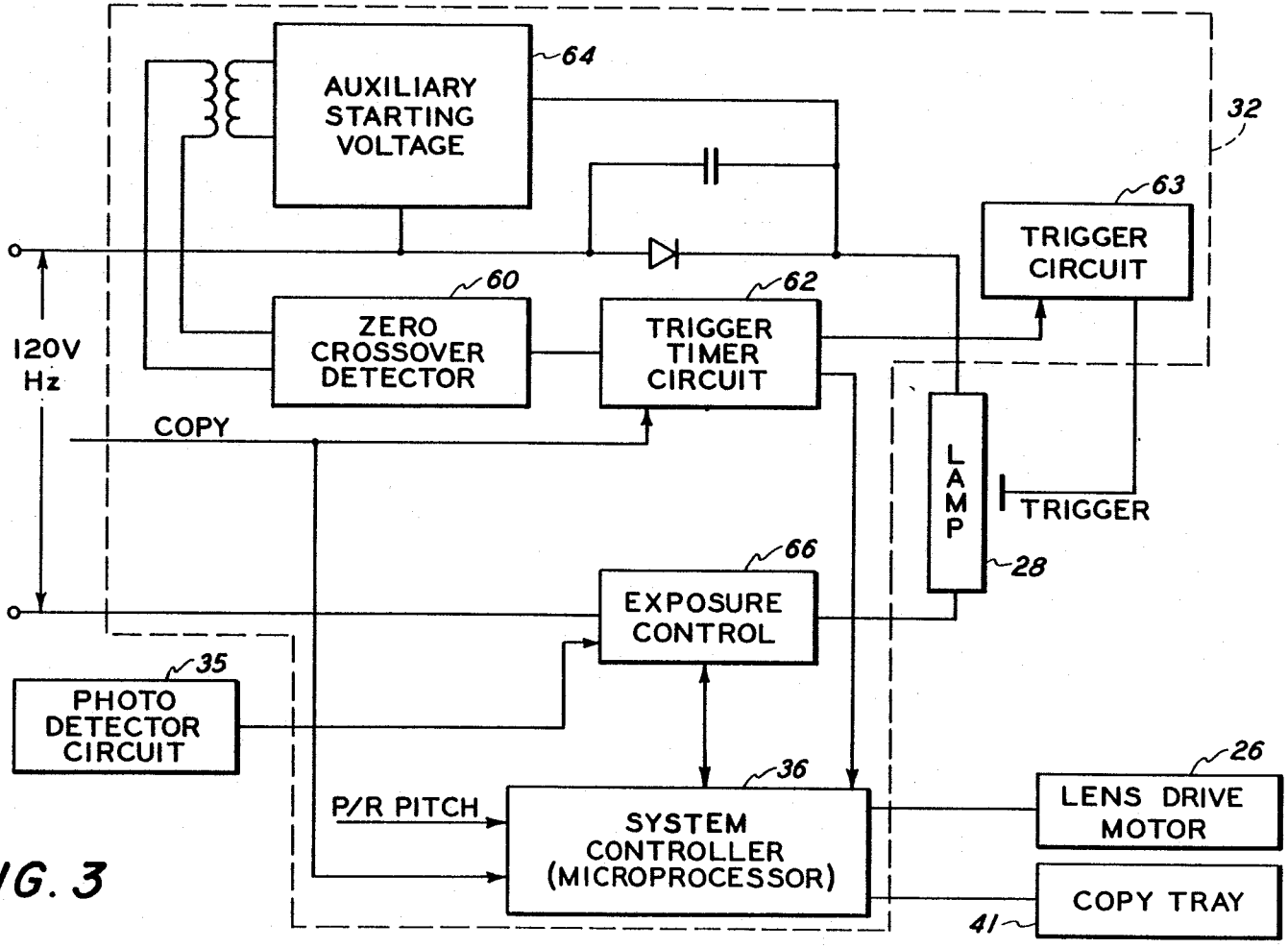
FIG. 3 is a block diagram of the control circuitry for coupling the flash lamp to the AC line.

Turning now to the application of energy to the lamp, control circuit 32 as shown in FIG. 3, comprises a zero crossover detector circuit 60 connected between the 120V, 60 Hz line supply and a trigger timer circuit 62. The zero crossover circuit is designed to detect the next zero crossover of the 60 Hz line following receipt of a copy signal and to send a clock signal to circuit 62. Each 60 Hz half cycle is 8.3 msec long. Trigger timing circuit 62 is the source for the trigger pulse applied to the lamp. Auxiliary start voltage circuit 64 is connected between the line input and the lamp and places a predetermined DC voltage across the lamp. Exposure control circuit 66, in conjunction with photodetector 35 provides an automatic feedback signal which provides real time sensing of the exposure characteristics of the particular document being copied. System controller 36 receives input on photoreceptor pitch, copy, lamp trigger and exposure control and regulates operation of the lens drive motor 26 and feeding of paper from tray 41. Controller 36, in a preferred embodiment, is an intel Model 8085, programmed to perform these xerographic functions as is known in the art.

Figure 4:
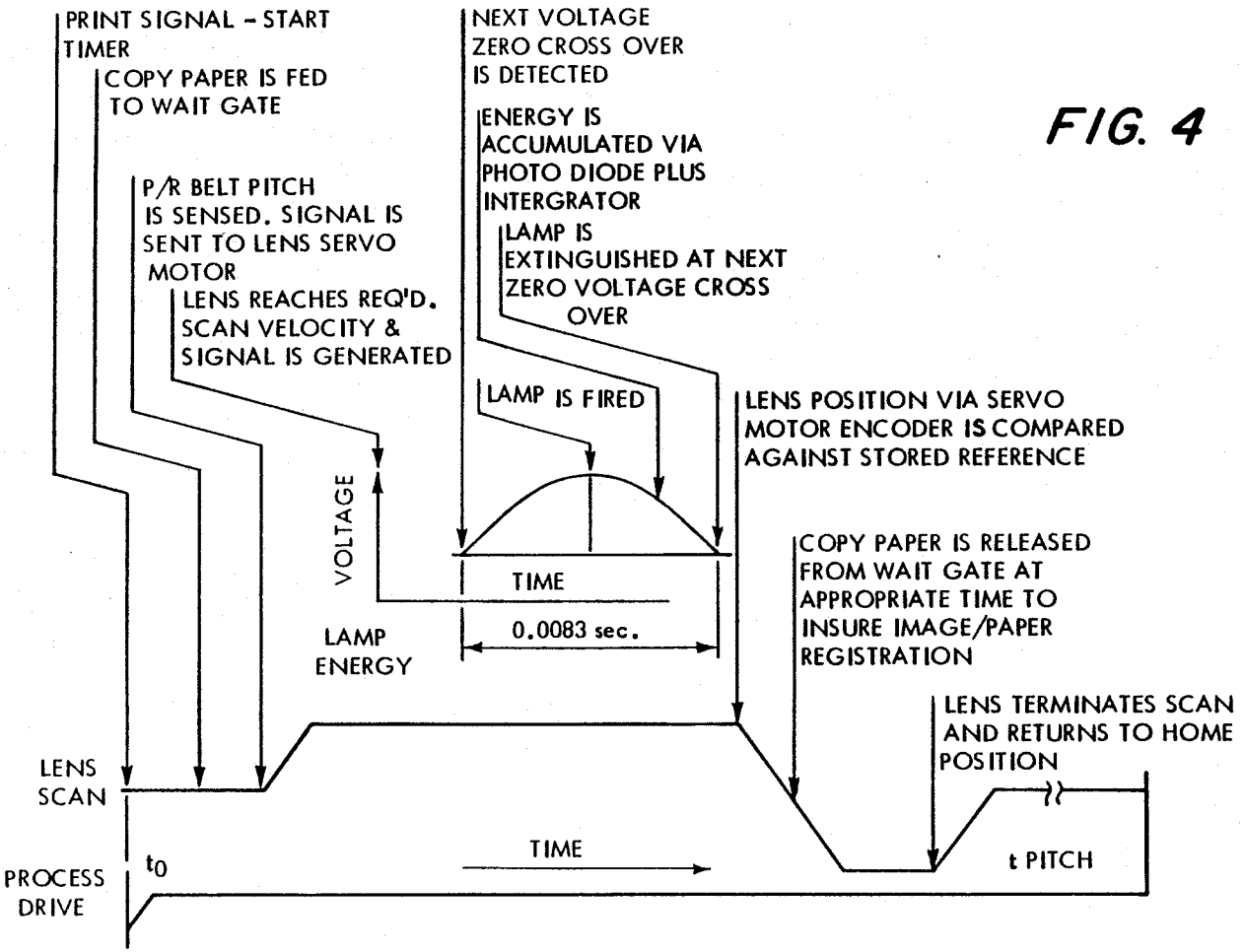
FIG. 4 is a timing diagram for an operational cycle of the imaging system of FIG. 1.

FIG. 4 shows a timing diagram illustrating the operation of the FIG. 3 circuitry. Prior to the start of the print cycle, lamp 28 presents an open circuit to the line. Referring to FIGS. 3 and 4, copy operation begins by activation of a copy switch. A copy signal is generated and sent to the trigger timer circuit 62 and to controller 36. The controller sends a signal to copy tray 41 to advance copy paper 40A to a "wait" position. The belt 10 pitch is sensed and a signal is sent to lens drive motor 26 to initiate the lateral scan movement of lens 22. The lens drive motor may be a servomotor capable of providing varying rates of speed to the lens. The detector circuit 60 senses the next zero crossover point of the AC line input and sends a delayed clock pulse to trigger timer circuit 62. The delay is provided so the lamp trigger will occur when sufficient line voltage is present to keep the lamp conducting. When the minimum voltage level is reached, a trigger signal is sent to the lamp. This high voltage trigger, in conjunction with the already existing auxiliary starting voltage level, (as required by the particular lamp design), causes the lamp to fire at the indicated cycle position. As a practical matter, the lamp cannot be flashed for the first two milliseconds after a zero crossing. The selection of the exact firing position thus controls the maximum pulse width and energy for that particular cycle. The maximum pulse width would normally be limited to the range of 2 to 6 milliseconds, unless a damp quenching technique is used, as described later.

During the flash sequence, photodetector 35 senses the reflected light from the particular document being copied and generates signals into a feedback circuit within exposure control circuit 66. The circuit compares the exposure level with a reference level associated with an optimum exposure and accumulates the exposure information.

Continuing with the timing description, the lamp is extinguished at the next zero crossing point. Lens 22 has moved at the predetermined rate relative to the photoreceptor motion and has provided the required exposure for the document being reproduced.

At completion of the lamp flash sequence, the controller releases the copy paper from the "wait" position at a time appropriate for registration at the transfer station. The controller also reverses the lens drive motor operation to return the lens to the start of scan position.

Figure 5:
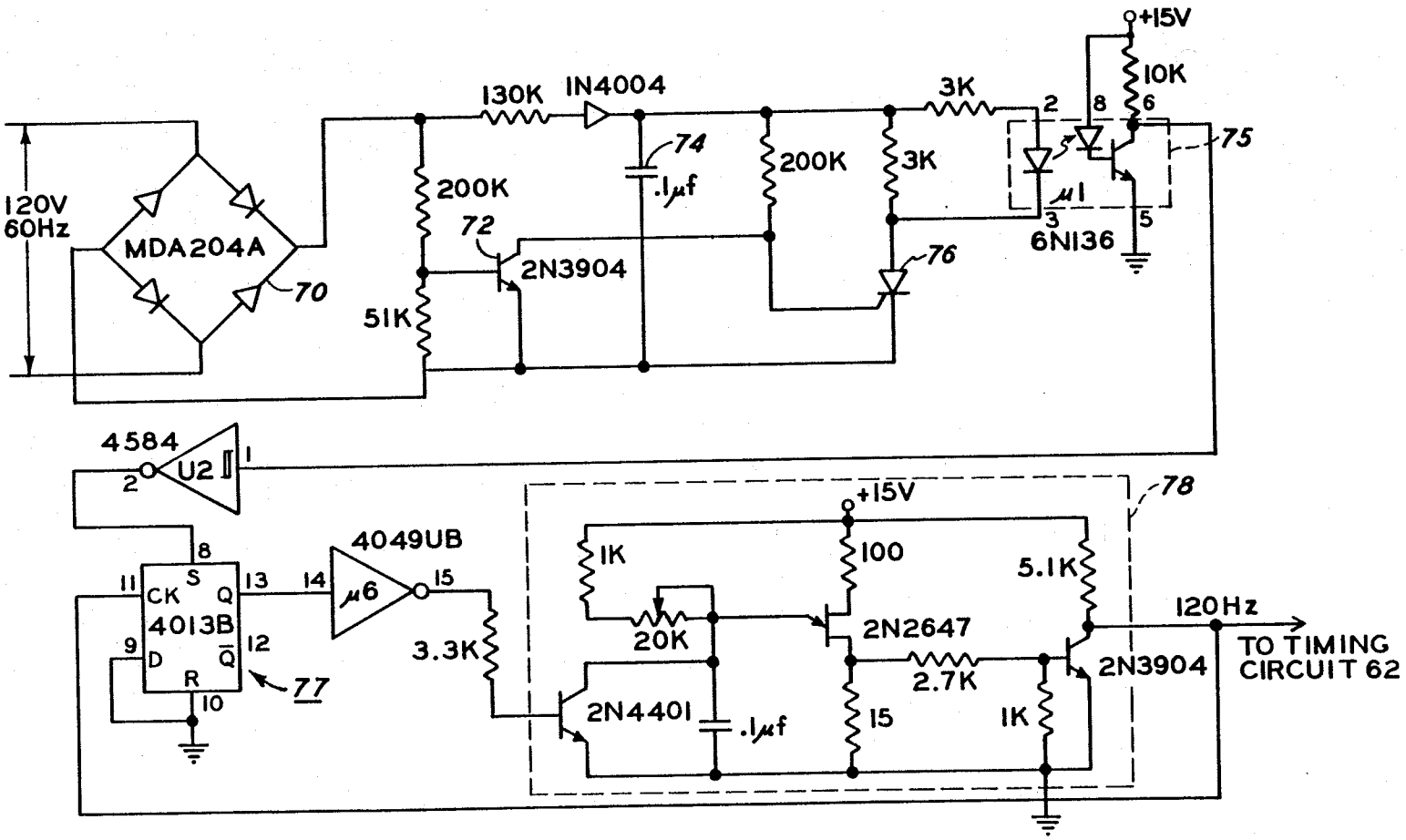
FIG. 5 is a circuit diagram of one embodiment of a zero crossover detector circuit.
Figure 6:
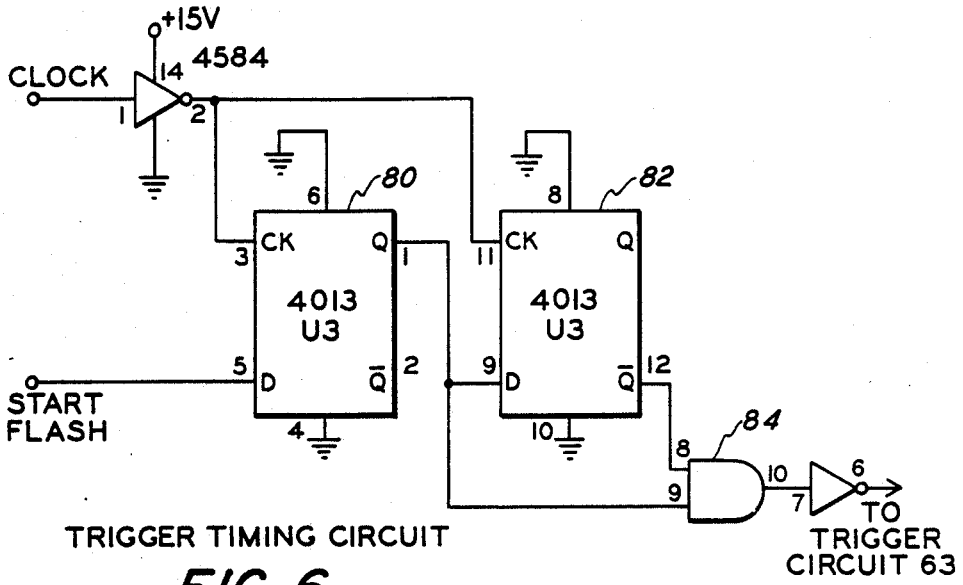
FIG. 6 is a circuit diagram of one embodiment of a trigger timer circuit.

A specific circuit design for the zero crossover detector circuit 60 and for the trigger timing circuit 62 is shown in FIGS. 5 and 6 respectively.

Referring to FIG. 5, the next zero crossover on the 120 volt line produces an output from rectifier circuit 70, turning transistor 72 off. Capacitor 74, which had been charged during the previous half cycle, discharges through optic coupler 75 and SCR 76, initiating a signal which sets flip flop 77. Setting flip flop 77 enables the unijunction transistor delay circuit 78 to provide a delayed clock signal which then clears the flip flop. The delayed clock signal is sent to trigger timing circuit 62. Circuit 62, shown in FIG. 6, includes flip flop pair 80, 82 having outputs to AND gate 84. The delayed clock signals have no effect on circuit 62 until the start of the copy signal is sent to circuit 62. Once present, the next delayed clock signal will cause flip flop 80 to go true. Since the not Q output of flip flop 82 is applied to AND gate 84, the AND gate output will go true. This condition will last until the next delayed clock signal causes flip flop 82 to go true thereby removing one of the two true inputs to AND gate 84. AND gate 84 produces a signal which is amplified and sent to trigger circuit 63, generating the trigger signal to start the lamp. The lamp is then directly coupled to the AC line for a period of time determined by exposure control circuit 66.

Turning now to a further consideration of the exposure control circuit 66, according to one aspect of the invention, the circuit includes a combination of components which use a photodetector input to determine the amount of illumination required to regulate exposure during a line cycle and to select the points along the ac line input waveform at which the lamp is triggered. The circuit function is to maintain a predetermined uniform exposure level at the photoreceptor by compensating for gain of the cavity 18, variable lamp output and for variations in document density.

Figure 7:
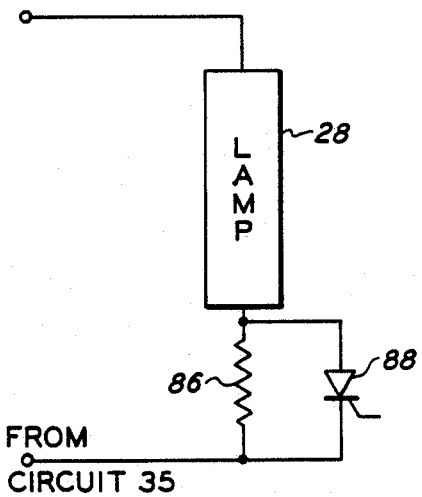
FIGS. 7 and 8 are circuit diagrams of a first and second exposure control circuit for a single pulse system.

FIG. 7 is representative of a circuit wherein a resistor 86 and SCR 88 are connected in parallel with the flash lamp 28. At the start of the cycle exposure, SCR 88 is off and resistor 86 limits the lamp current. At some time during the 8 millisec pulse, an integrated signal from photodetector circuit 35 switches on SCR 88. Resistor 86 is shorted out, increasing the lamp current (and light output) during the remaining portion of the cycle.

Figure 8:
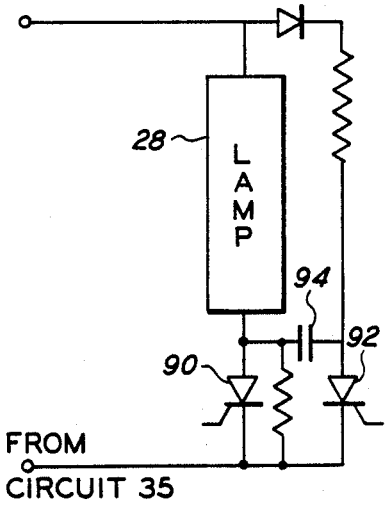

A second method of controlling the lamp operation is to trim or quench, the lamp output. This can be accomplished by placing an SCR in series with the lamp. FIG. 8 shows a circuit arrangement wherein SCR 90 is in series with the lamp output; SCR 92 and capacitor 94 are used to switch off SCR 90 once the correct exposure is reached as determined by the signal from circuit 35. The circuit can be modified by using a transistor in series with the lamp instead of the SCR. The transistor then turns off once sufficient exposure has been reached.

Figure 9:
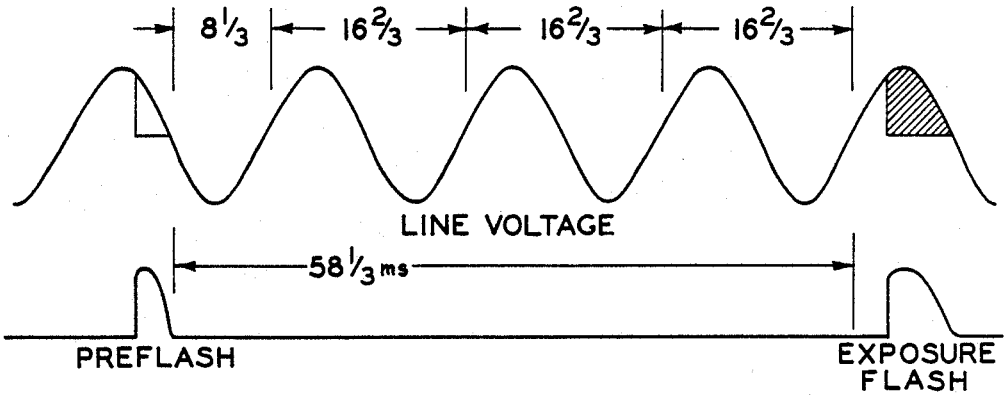
FIG. 9 is a plot of line voltage over time indicating one example of the interval between an initial illumination pulse and a second exposure pulse in a multiple pulse exposure mode.

A third exposure control technique is to obtain information on document density by flashing a lamp before exposure (preflash). The signal from photodetector 35 is sent to system controller 36 where a preflash circuit calculates the time at which the main flash lamp is to be triggered into operation. Preferably, the low energy preflash lamp is operated from a DC souce connected to the source line that supplies the main flash lamp. This arrangement would compensate for any slow line voltage variability. The preflash can also be accomplished by using the main flash lamp. For this case, where the energy is much higher a shutter would be required to prevent exposure during the preflash period. The shutter would then be opened during the exposure flash. FIG. 9 shows the timing of the two flashes and their relationship to the line voltage. Since the lamp firing is related to line frequency, the time between the two flashes must be a multiple of $8\frac{1}{3}$ milliseconds. Another operative factor governing the time interval is that the exposure flash cannot occur during the period the voltage is crossing zero and for the first two milliseconds thereafter.

Figure 10:
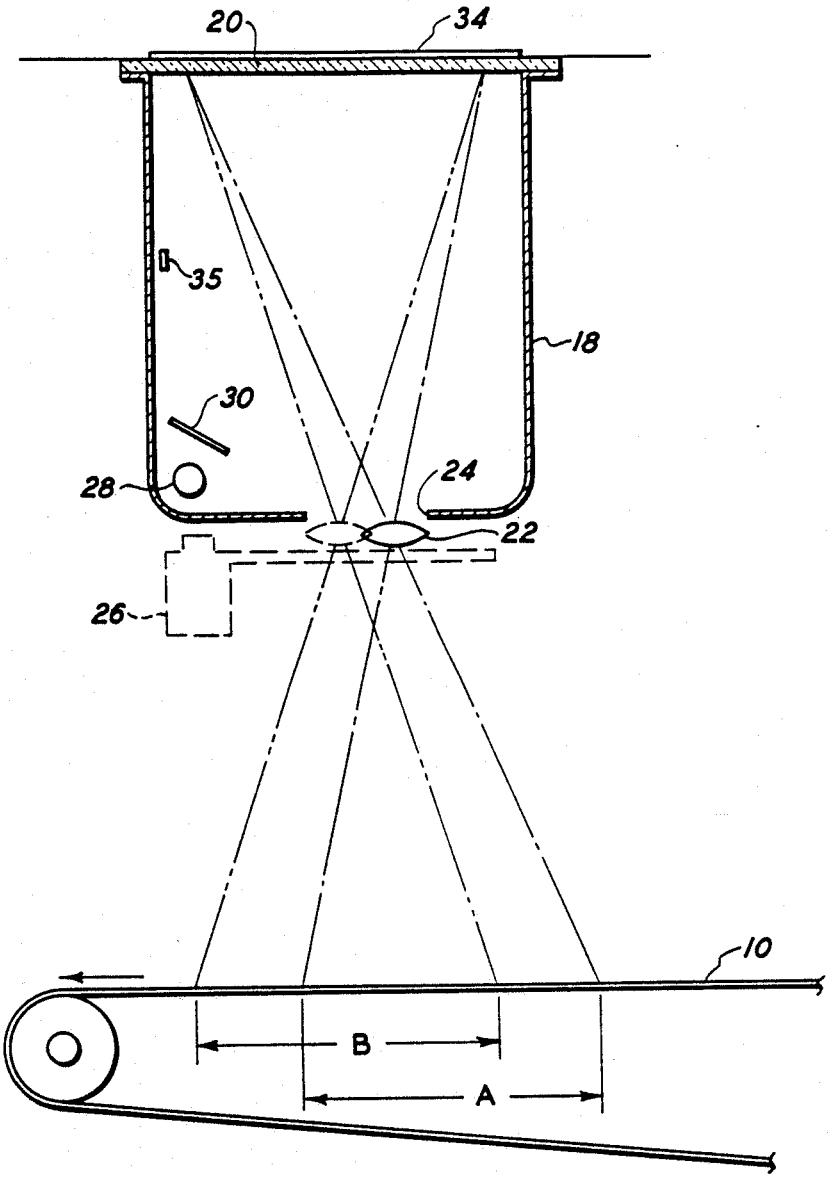
FIG. 10 is a modified view of the FIG. 2 imaging system showing lens and photoreceptor movement through two flash cycles.
Figure 11:
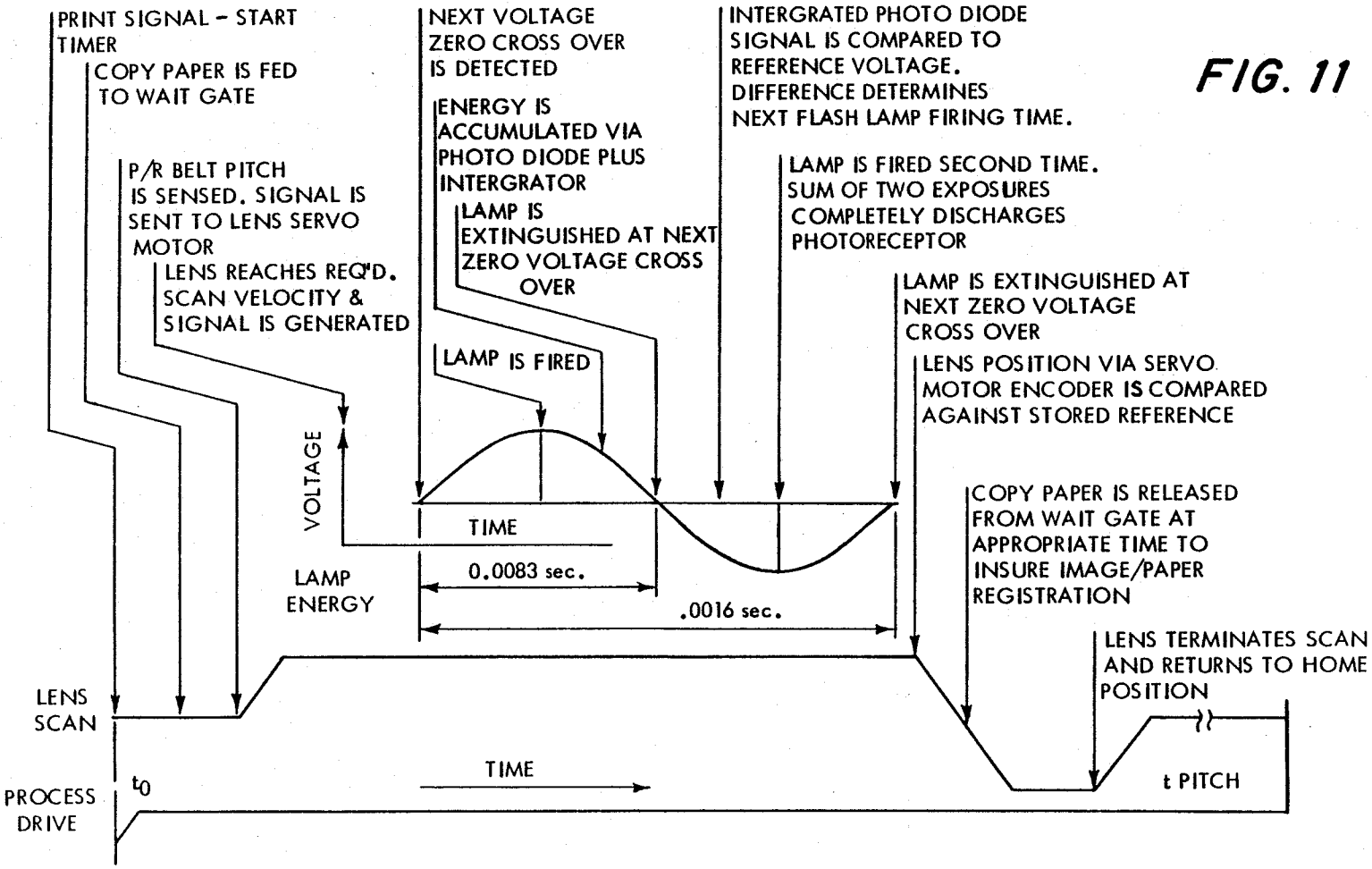
FIG. 11 is a timing diagram for two operational cycles.

The above description of imaging system 16 assumed that a signal flash of 3–6 ms duration provided sufficient exposure at the photoreceptor surface. Due to differing factors such as photoreceptor sensitivity, type of flash lamp, etc., it may be necessary to produce successive flash intervals during successive half cycles of line operation; e.g. successive pulses of the AC line voltage are applied to the lamp. FIG. 10 shows a modification of the FIG. 2 side view of imaging system 16, illustrating a two flash system. Lens 22 is thus shown in a first position consistent with initiation of a first flash and at a second dotted line position consistent with initiation of a second flash. Given the same assumption previously used for the single flash case (1:1 magnification, photoreceptor moving at 20 in/sec); the lens must travel at 10 in/sec during each flash interval. During a first flash interval, the photoreceptor and lens travel a distance of 0.16 and 0.08 inch respectively to form a latent image of the document along zone A. During the second flash interval, the photoreceptor and lens move the same distance superposing a second image in zone B in precise registration with the first image. The timing sequence is shown in FIG. 11. The sequence for the first flash interval is as described above for the single flash case. At detection of the second zero crossover point, detector circuit 60 again generates a clock pulse signal which is sent to trigger timer circuit 62. When the line voltage reaches the minimum start voltage level, the lamp is again triggered into operation. Lens 22, which has been continually moving with the photoreceptor, projects a second exposure of the document image onto the same, previously exposed area. In this multiple pulse mode, the length of the second pulse is controlled by exposure control current 66 operating upon the integrated feedback signal from photodetector 35 to provide the photoreceptor with the proper exposure.

Figure 13:
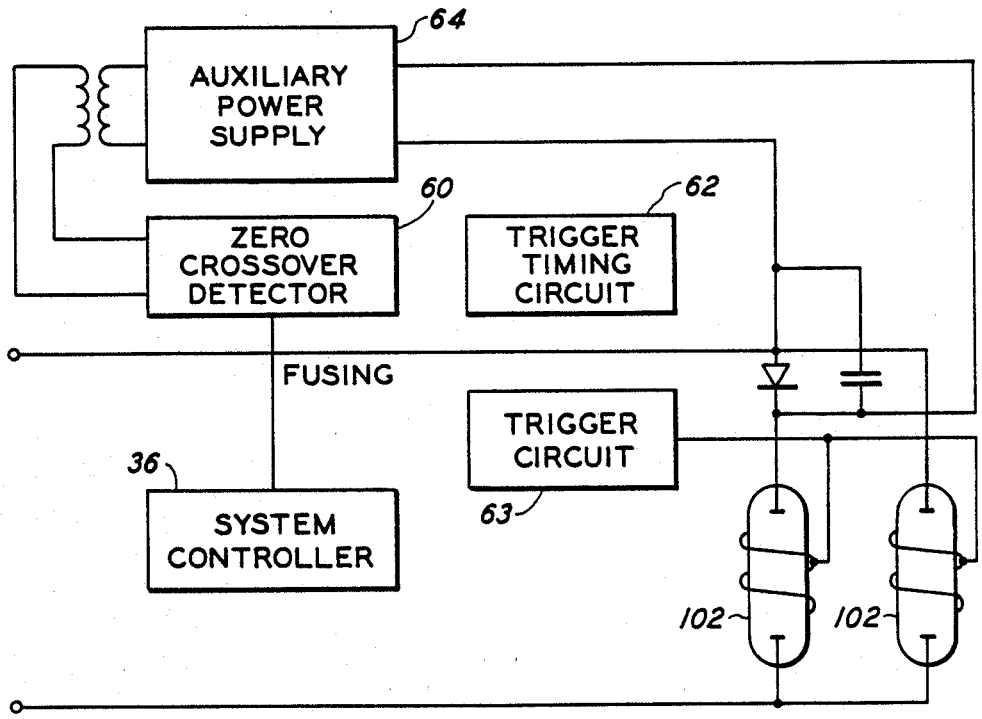
FIG. 13 is a schematic of the control circuitry coupling AC line voltage to the flash fuser assembly of FIG. 12.
Figure 12A:
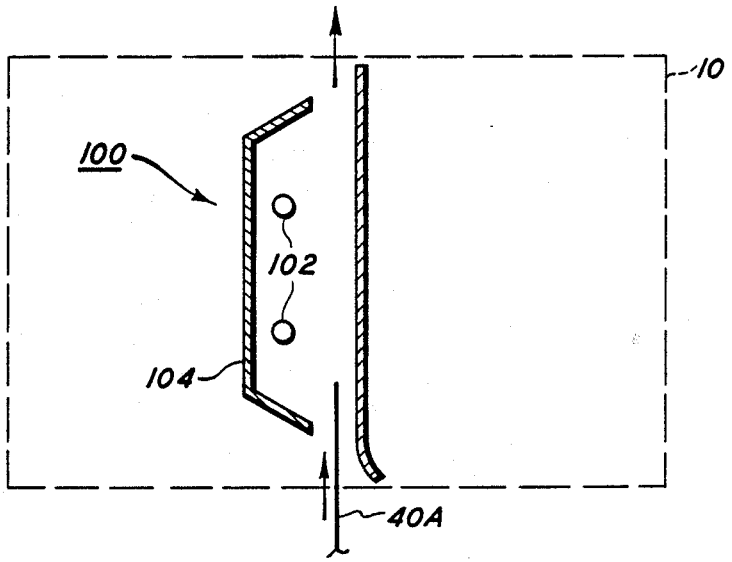
FIG. 12A, 12B shows a flash fuser assembly disposed above a photoreceptor.
Figure 12B:
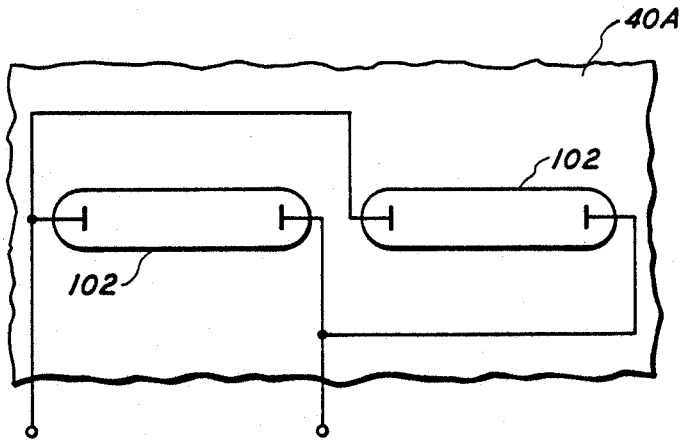

As described above, the control circuitry can also be adapted to power other xerographic functions requiring flash radiant energy. FIG. 12 shows one embodiment of a flash fuser assembly 100 utilizing two xenon flash lamps 102, contained within reflective housing 104 operating in parallel and extending across the width of a copy sheet bearing a toner image. FIG. 13 shows a circuit control diagram for operation of the flash assembly 100. Upon application of a fusing signal from system controller 36, the zero crossover detector circuit 60 senses the next zero crossover point of the AC line input and sends a delayed clock pulse output to timing circuit 62. When the line voltage reaches a minimum voltage level, a trigger signal is developed within trigger circuit 63 and sent to the lamps which then fire for a predetermined time interval. The lamps will be fired upon successive half cyles until the transferred image under the reflective housing 104 has been fused. The last flash interval will be monitored by counting circuitry within controller 36 which will generate an inhibit signal sent to detector circuit 36. Although only two lamps have been shown, additional lamps may be required to achieve satisfactory fusing. These lamps may be arranged in a "ripple" pattern as disclosed in U.S. Pat. No. 4,434,353, whose contents are hereby incorporated by reference.

The control circuitry described in connection with the flash exposure and flash fusing system can be adapted to control other functions in the reproduction machine which trigger the generation of radiant energy. As examples, some machines require a discharge lamp to be positioned above the photoconductive surface at a position between the cleaning and charging station of FIG. 1. The lamp is flashed to discharge any residual electrostatic charge remaining on the photoreceptor surface prior to charging. The flashing of this lamp can be controlled by the control circuitry of the present invention. Additional examples are of lamps which are periodically energized to dissipate unwanted charge areas adjacent the images of a latent iamge or charge areas between the top and bottom edges of successively formed latent images (inter-document gaps).

Although the invention has been described in relation to the embodiments shown herein, other embodiments, variations and modifications are possible consistent with the principles of the invention. Thus, although the printing machine of FIG. 1 shows a moving lens and moving photoreceptor belt, for some reproduction systems, it may be possible to hold the photoreceptor motionless during the flash periods. For this type of system, the lens can remain in a fixed position and the flash lamp fired the requisite number of times. Control circuitry must be added to controller 36 to restart the belt following the requisite number of flashes and to make the necessary adjustments in the system timing function.

As another example of a possible modification, the lens may be held stationary and the platen moved so as to convey the document to a second or subsequent position to coincide with the timing of the flashes. Alternatively, only the document may be moved by a document transport means to new positions. Controller 36 would, for this case, be modified to synchronize operation of the platen of document drive mechanism with the flash firings and photoreceptor movement.

As a still further modification, the invention can be practiced with any of the conventional line voltages; e.g. 208V, 60 Hz.

Finally, the present embodiment has been described operating in a unity magnification mode. The system can operate at other magnifications consistent with change in the scanning speed and with conjugate adjustment of the optical components. One example of a flash exposure system operating through a magnification range is provided in U.S. Pat. No. 4,466,734.

All of the modifications and variations are intended to be included by the following claims:

What is claimed is:

1. An electrophotographic document reproduction machine comprising, in combination, means for charging the surface of a photoreceptor medium, a full-frame flash-exposure system for illuminating the document and for projecting an image onto said charged surface to form a latent image of the document thereon said exposure system including a flash lamp which is energized to provide a pre-exposure (preflash) radiation output and at least one radiation output during an exposure cycle, said exposure system further including a photodetector for sensing the preflash radiation and the exposure radiation said exposure system further including feedback control means connected between the photodetector and the lamp, said feedback control means adapted to calculate and trigger the exposure lamp into operation based on the preflash input signal from the photodetector and to adjust the lamp output to provide the output radiation level for a required document exposure;

means for developing said latent image and for transferring said developed image to an output sheet and means for fusing said transferred image onto said output sheet;

said machine further including control means connected between an AC line input and at least said exposure system, said control means adapted to cause said exposure system to produce a flash exposure pulse during at least one half cycle of said AC input, said control means including a zero crossover detector circuit adapted to sense the next zero point crossover of said line input and to generate a delayed clock signal indicative of this crossover event, said control means further including a trigger timer circuit, which receives the clock signal from said zero crossover detector circuit, and generates a lamp trigger signal.

2. The reproduction machine of claim 1, wherein the time between the preflash output and the flash exposure output is a multiple of the input frequency half-cycle duration.

* * * * *